US005955828A

United States Patent [19]

Sadwick et al.

[11] Patent Number: 5,955,828

[45] Date of Patent: Sep. 21, 1999

[54] THERMIONIC OPTICAL EMISSION DEVICE

[75] Inventors: Laurence P. Sadwick; R. Jennifer Hwu, both of Salt Lake City, Utah

[73] Assignee: University of Utah Research Foundation, Salt Lake City, Utah

[21] Appl. No.: 08/951,409

[22] Filed: Oct. 16, 1997

Related U.S. Application Data

[60] Provisional application No. 60/029,131, Oct. 16, 1996.

[51] Int. Cl.[6] ..... H01J 1/05

[52] U.S. Cl. ..... 313/310; 313/422; 313/495

[58] Field of Search ..... 313/422, 446, 313/447, 498, 458, 460, 495, 496, 497, 308, 310

[56] References Cited

U.S. PATENT DOCUMENTS

| | | | |
|---|---|---|---|
| 3,665,241 | 5/1972 | Spindt et al. | 313/351 |
| 3,701,919 | 10/1972 | Geppert | 313/250 |
| 3,748,522 | 7/1973 | Geppert | 313/310 |
| 3,755,704 | 8/1973 | Spindt et al. | 313/309 |
| 3,824,478 | 7/1974 | Mueller | 328/37 |
| 3,970,887 | 7/1976 | Smith et al. | 313/309 |
| 3,978,364 | 8/1976 | Dimeff et al. | 313/306 |
| 3,983,442 | 9/1976 | Jariwala et al. | 313/251 |
| 4,019,081 | 4/1977 | Buxbaum et al. | 313/346 R |
| 4,020,381 | 4/1977 | Oess et al. | 313/302 |
| 4,163,949 | 8/1979 | Shelton | 328/254 |
| 4,298,814 | 11/1981 | Takanashi et al. | 313/302 |

(List continued on next page.)

OTHER PUBLICATIONS

"Design, Fabrication and Testing of Microminiature Vacuum Tube Electronics", Y. Zhang, Department of Electrical Engineering, University of Utah, Jun. 1995, pp. 1–82.

"Flat Displays for receivers and Monitors", J. Anderson et al., International Broadcasting Convention, Sep. 16–20 1994, pp. 483–488.

"Progress in Microminiature Thermionic Vacuum Tube Devices", L.P. Sadwick et al., *IEDM*, 1994, pp. 779–782.

"Thermal Applications of Microbridges", C. Mastrangelo, Ph.D., *UMI Dissertation Services*, 1994, pp. 1–388.

"Microcavity Vacuum Tube Pressure Sensor for Robot Tactile Sensing", J.C. Jiang, *IEEE*, 1991, pp. 238–240.

"Physical Considerations in Vacuum Microelectronics Devices", I. Brodie, *IEEE Transactions on Electron Devices*, vol. 36, No. 11, Nov. 1989, pp. 2641–2644.

"Fluorescent Indicator Panel with Simple Diode Construction", M. Yamaguchi, *SID Digest*, 1987, pp. 100–102.

"Color Graphic Front Luminous VFD", T.L. Pykosz et al., *SID Digest*, 1985, pp. 366–369.

"Thermionic Integrated Circuits: A Status Report", D. Wilde, Final Report to Geothermal Energy, Oct. 1980, pp. 1–80.

*Primary Examiner*—Vip Patel

*Attorney, Agent, or Firm*—Madson & Metcalf

[57] ABSTRACT

A thermionic optical emission device employs a two dimensional array of thermionic elements to excite a display material, such as a phosphor coating, thus producing the image viewed by an observer. Each pixel of the desired display corresponds to the electron emissions of thermionic elements. Each pixel may correspond to less than 1 or more than 1000 thermionic elements. In color displays, each pixel of the desired display includes an area of red phosphor, blue phosphor, and green phosphor. Each of the thermionic elements included in the thermionic optical emission device includes a substrate, a conductive material formed on the substrate and forming electrically isolated segments, a cathode formed adjacent to the conductive material and electrically coupling the isolated segments and emitting electrons when heated, a void adjacent the cathode to reduce heat dissipation, a luminescent material disposed on a screen to receive and react to electrons emitted by the cathode and thereby produce an optical emission, and a vacuum separating the cathode and the luminescent material. The thermionic optical emission device can be embodied as a diode, triode, or higher electrode device.

22 Claims, 6 Drawing Sheets

U.S. PATENT DOCUMENTS

| | | | |
|---|---|---|---|
| 4,356,427 | 10/1982 | Noguchi et al. | 313/422 |
| 4,429,250 | 1/1984 | Clerc et al. | 313/336 |
| 4,513,308 | 4/1985 | Greene et al. | 357/55 |
| 4,618,801 | 10/1986 | Kakino | 313/495 |
| 4,658,181 | 4/1987 | Cooper et al. | 313/346 R |
| 4,683,399 | 7/1987 | Soclof | 313/537 |
| 4,712,039 | 12/1987 | Hong | 313/307 |
| 4,721,885 | 1/1988 | Brodie | 313/576 |
| 4,780,684 | 10/1988 | Kosmahl | 330/54 |
| 4,855,636 | 8/1989 | Busta et al. | 313/306 |
| 4,924,137 | 5/1990 | Watanabe et al. | 313/337 |
| 4,983,878 | 1/1991 | Lee et al. | 313/308 |
| 4,987,377 | 1/1991 | Gray et al. | 330/54 |
| 5,007,873 | 4/1991 | Goronkin et al. | 445/49 |
| 5,030,879 | 7/1991 | Derks | 313/246 |
| 5,038,070 | 8/1991 | Bardai et al. | 313/309 |
| 5,053,673 | 10/1991 | Tomii et al. | 313/308 |
| 5,118,983 | 6/1992 | Morita et al. | 313/340 |
| 5,173,634 | 12/1992 | Kane | 313/306 |
| 5,181,874 | 1/1993 | Sokolich et al. | 445/24 |
| 5,199,918 | 4/1993 | Kumar | 445/50 |
| 5,203,731 | 4/1993 | Zimmerman | 445/24 |
| 5,216,324 | 6/1993 | Curtin | 313/495 |
| 5,220,238 | 6/1993 | Lee | 313/270 |
| 5,259,799 | 11/1993 | Doan et al. | 445/24 |
| 5,285,131 | 2/1994 | Muller et al. | 313/578 |
| 5,289,078 | 2/1994 | Kitao et al. | 313/310 |
| 5,381,069 | 1/1995 | Itoh et al. | 313/310 |
| 5,397,957 | 3/1995 | Zimmerman | 313/309 |
| 5,399,238 | 3/1995 | Kumar | 156/643 |
| 5,411,426 | 5/1995 | Boysel | 445/25 |
| 5,436,530 | 7/1995 | Suzuki et al. | 315/169.1 |
| 5,463,269 | 10/1995 | Zimmerman | 313/309 |
| 5,463,271 | 10/1995 | Geis et al. | 313/346 R |
| 5,463,277 | 10/1995 | Kimura et al. | 315/169.1 |
| 5,475,281 | 12/1995 | Heijboer | 313/337 |
| 5,502,314 | 3/1996 | Hori | 257/10 |
| 5,505,647 | 4/1996 | Sato et al. | 445/25 |
| 5,508,584 | 4/1996 | Tsai et al. | 313/497 |
| 5,541,466 | 7/1996 | Taylor et al. | 313/310 |
| 5,569,974 | 10/1996 | Morikawa et al. | 313/310 |
| 5,572,041 | 11/1996 | Betsui et al. | 257/10 |
| 5,604,394 | 2/1997 | Saito et al. | 313/422 |
| 5,725,787 | 3/1998 | Curtin et al. | 313/422 |

THERMIONIC OPTICAL EMISSION DEVICE

CROSS-REFERENCE TO RELATED APPLICATION

This application claims the benefit of U.S. Provisional Application No. 60/029131, filed Oct. 16, 1996.

BACKGROUND

1. The Field of the Invention

The invention relates generally to emission devices employing a display means to produce an image. More specifically, the present invention relates to an optical emission device employing thermionic elements constructed with solid-state semiconductor device, micromachining, or microelectromechanical (MEM) fabrication techniques in combination with corresponding display means.

2. The Background Art

The development of television necessarily led to the parallel development of display devices. The classic display device utilizes cathode ray tubes ("CRT"). Initially, with black and white television, a single cathode gun located inside a cathode ray tube was used to project the desired signal to the phosphor coating on the picture tube. The phosphor coating, in turn, was illuminated as dictated by the signal received, thus producing the monochrome, or grayscale, images seen by an observer.

Color display technology operates in similar fashion but requires a cathode ray tube which employs a series of guns. Each gun emits an electron emission which illuminates a different color of phosphor on the display screen. Typically, three guns are used to illuminate red, green, and blue phosphors. By using red, green, and blue in varying combinations and intensities, any color may be achieved. This process is often referred to as the additive process of producing color.

As might be expected, however, CRT display systems have certain drawbacks. For example, CRTs are limited in the size of picture which can be displayed with acceptable quality. This is because increasing the picture size requires greater electron emission by the guns. At some point, increasing the picture size will exceed the capability of the guns to produce an acceptable picture. Increasing the picture size will at some point also exceed practical weight limitations for fabrication. Furthermore, CRTs require substantial space for implementation. In today's ever expanding display market, larger displays produced by smaller sized devices are desired features in a display system.

The advent of computers and a variety of other technologies also led to additional development in the area of displays. Today, home theater systems, camcorders, graphics systems, virtual reality systems, commercial transportation systems, cable, telephone, interactive media services, personal projections systems, personal digital assistants, virtual reality driven materials handling systems, automotive global positioning systems, and a variety of other systems in various fields of information display as well as television and computers all require display technology to operate. Such demand has naturally led to certain advancements in the field.

One such advancement is the liquid crystal display ("LCD"). The LCD was initially developed primarily for use in calculator and watch displays. More recently LCDs using a flat panel design have been implemented for television, lap top computers, and other applications. LCDs have had some success in providing a thinner screen in space restrictive applications. Unfortunately, these LCD display systems exhibit a number of major drawbacks, including excessive manufacturing costs, limited large screen capabilities, backlighting requirements, viewing angle limitations, and operating temperature limitations.

Other flat panel display technologies are also developing. Among these is the so called field emission display (FED). FEDs rely on the field emission from pointed tips under high electric fields. Unfortunately, FEDs also exhibit certain undesirable characteristics such as complex manufacturing and reliability concerns.

In the 1987 edition of the Scientific Information Display Digest, an article titled Fluorescent Indicator Panel with Simple Diode Construction by Masanobu Yamaguchi, Kazuo Kaneko, and Hirokichi Seo disclosed an experimental flat diode structure for use in a flourescent indicator panel. The diode structure used a tungsten cathode filament of one micron in thickness to provide electron emissions to a phosphor screen. A noted disadvantage was that the power consumption of the cathode filament was too high for practical application. Furthermore, because of the thermal diffusion of the cathode filament, the electrical pulse time of the diode structure was, at a minimum, 3 milliseconds. The electrical pulse time is the amount of time in which a thermal source is applied to the cathode filament to generate an electron emission. Electrical pulse times of 3 milliseconds are unsuitably high for most display purposes. The article concluded that the flat diode was impractical to be used as a display because the power consumption of the filament was too great and the pulse time of the emission was too high.

Thus, it would be an advancement in the art to provide a display device which produces high quality monochrome or color images over a broader range of display sizes yet requires less space and power for implementation.

It would be another advancement in the art to provide a display device which is operable in high temperatures and high radiation conditions.

It would be yet another advancement in the art to provide a display device which is relatively easy to manufacture, practical, reliable, and reproducible.

It would be a further advancement in the art to provide a display device incorporating electron emission principles while eliminating previous limitations.

Such an invention is disclosed and claimed herein.

BRIEF SUMMARY AND OBJECTS OF THE INVENTION

The present invention provides a thermionic optical emission device employing microminiature thermionic elements formed by deposition which emit electrons to excite a phosphor coating on a screen. The microminiature thermionic elements are referred to herein as thermionic elements. In one presently preferred embodiment of the invention, the emission device comprises a two dimensional array of the thermionic elements. The thermionic elements and methods of manufacture are described in copending patent application Ser. No. 08/547,670 filed Oct. 17, 1995. The emission device also comprises a screen which is disposed a certain distance from and parallel to the array. The screen has a side facing the array coated with phosphor. The phosphor coating receives and reacts to the electron emissions of the individual thermionic elements of the array to produce an optical emission. The resulting optical emission creates an image on the screen.

In the preferred embodiment, less than 1 to over 1000 thermionic elements are associated with each pixel of the desired display, a pixel being the smallest addressable element of the produced image. Utilization of high numbers of thermionic elements for each pixel yields a highly reliable display system. The pixel size is also scalable by configuring the array to provide a different number of thermionic elements to each pixel.

In color display applications, a number of thermionic elements are associated with a red area of phosphor, a blue area of phosphor, and a green area of phosphor for each pixel. The thermionic elements excite the associated phosphor to the intensity dictated by a received control signal to produce the desired color.

In one presently preferred embodiment, the thermionic element comprises an insulating or highly resistive substrate. In an alternative embodiment, the substrate consists of a conductive material and an insulating layer on the top of the conductive material.

An electrically conductive material is formed on the substrate and is configured into two electrically isolated segments which are spaced apart to prevent contact by one another. A cathode filament is formed adjacent to the conductive material so that it is in electrical communication with the two electrically isolated segments thereby forming a series path between the segments. The two electrically isolated segments serve as conductors to deliver electrical energy to the cathode filament. When electrical energy is applied to one of the isolated segments of conductive material, the cathode filament is selectively heated and electrons are emitted therefrom. Accordingly, the applied electrical energy is a thermal source for the cathode filament.

In a presently preferred embodiment, there is a void adjacent to the cathode filament. The void serves to reduce the thermal load placed on the thermionic element by reducing heat dissipation from the cathode filament. The void may be configured as a column, trough, or trench. The isolated segments may be configured to surround and define the void. In such an embodiment, the void could act to separate the isolated segments. The void may also be formed to extend downwardly into a portion of the substrate. Alternatively, both the isolated segments and the substrate may define and surround the void.

A screen is disposed a certain distance from the cathode filament. A chamber, such as a vacuum, separates the screen and the cathode filament. The chamber may be formed and defined by glass as it typically done in other forms of flat panel display such as FEDs. The side of the screen facing the cathode filament is coated with phosphors. A voltage is applied to the phosphor to cause it to attract electrons emitted from the cathode filament. Accordingly, a voltage potential exists between the cathode filament and the phosphors. The phosphors receive and react to the electron emissions creating an optical emission which in turn creates an image on the screen. In this manner, the phosphor coating on the screen functions as the anode component in a conventional diode. The thermionic elements used by the invention are durable in that they are resistant to harsh environments such as high temperatures, high vibration, and high radiation.

In an alternative embodiment of the thermionic element, an electrically insulative layer is disposed on above or near the electrically conductive material. An electrically conductive control grid is then formed adjacent to the electrically insulative layer above the cathode filament to create a triode. The control grid defines an opening above the cathode filament which allows passage of electrons therethrough. A voltage is selectively applied to the grid to control the magnitude of the flow of electrons through the opening in the grid. As with conventional triodes, controlling the magnitude of the electron flow will in turn effect the electrical current produced by the anode.

Control of the electron emission of the thermionic element is dictated by a control signal sent to the thermionic element. A single or a plurality of control signals determine the application of the energy source to the cathode filament and the voltage to the grid. The intensity of the optical emission directly corresponds with the strength of the received electron emission. Accordingly, increasing the applied grid voltage will increase the electron emission and the intensity of the image.

A controller board is electronically coupled to the array of thermionic elements and controls the thermionic elements by sending appropriate control signals to them. The control signal will dictate the amount of energy source and voltage applied to an individual thermionic element. In this manner, the intensity of the electron emissions of an individual thermionic element can be turned on or off or even varied in intensity as desired. In a preferred mode of operation the electron emissions are pulsed as needed by selectively turning the thermionic element on and off. The controller board allows minimalization of power consumption by reducing the energy source and voltage to the individual thermionic elements. Alternatively, the energy source may be increased to provide optimal performance of the emission device. Furthermore, the controller board may selectively increase or decrease the intensity of certain pixels on the emission device. The emission device can have a relatively small thickness and yet have a large screen. Thus, the invention allows for flat panel display devices which are not limited in screen size as are LCDs.

Thus, the present invention provides an emission device comprising thermionic elements which may be manufactured using, among others, semiconductor, thick film, micromachining, and microelectromechanical system (MEMS) fabrication techniques to achieve a highly reliable display device.

The present invention further provides an emission device which has a narrow width yet produces bright sharp images across a wide range of desired display sizes.

The present invention also provides an emission device with variable intensity and scalable pixel size which can be configured to provide minimal power consumption or optimal performance.

The present invention additionally provides an emission device which is operable in high temperature or low temperature environments and in high radiation environments.

These advantages of the present invention will become more fully apparent by examination of the following description of the preferred embodiments and the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREPFERRED EMBODIMENTS

Reference is now made to the embodiments and methods illustrated in FIGS. 1 through 7 wherein like numerals are used to designate like parts throughout. Referring to FIG. 1A, a side, cross-sectional view of the thermionic element for use in the emission device of the present invention is generally designated at 10. Thermionic elements are based on vacuum tube electronics technology combined with microdevice technology. Operation of the thermionic element relies on the concept of naturally high-temperature thermionic emission. The thermionic element comprises a cathode filament 12 which emits electrons. These electron emissions are received by an anode 14 which in turn produces an optical emission. The cathode 12 is selected so that application of energy energy to the cathode 12 will result in thermionic electron emission. In the presently preferred embodiment the anode 14 consists of a luminescent material, such as phosphor. The anode 14 is positively charged to attract the electron emission and is spaced a certain distance from the cathode 12. The composition of the thermionic element makes them ideally suited to function as a diode or triode as well as other devices.

Figure 1A:
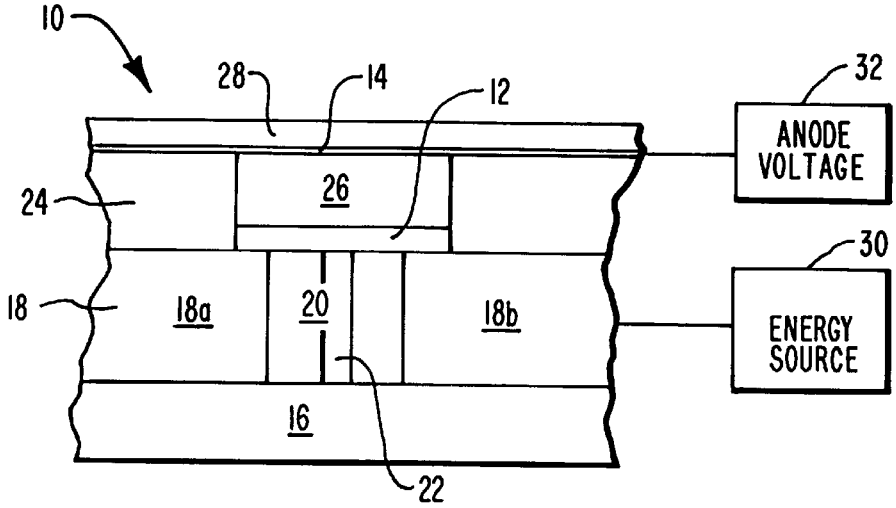
FIG. 1A is a side, cross-sectional view of a thermionic element usable in the emission device of the prevent invention.
Figure 1B:
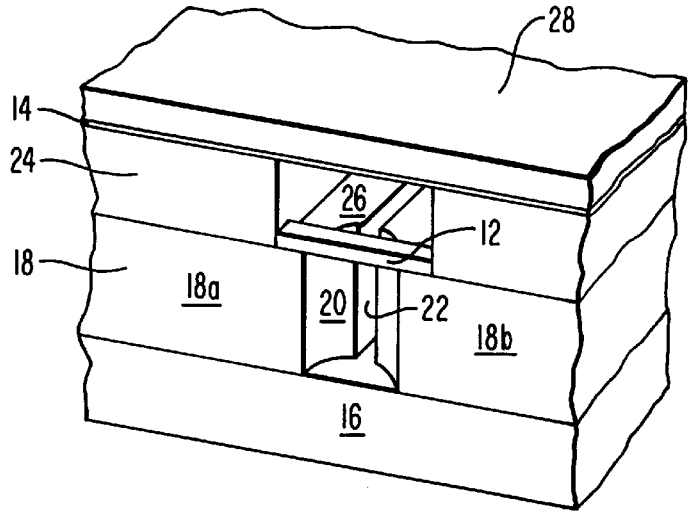
FIG. 1B is a perspective view of the thermionic element shown in FIG. 1A.

The specific components of the thermionic element as depicted in FIGS. 1A and 1B are now discussed. In addition to the cathode filament 12 and the anode 14, the thermionic element comprises a substrate 16. The substrate 16 can be any substrate material commonly known in the art such as a polycrystalline material, an amorphous material, or a variety of silicon type materials or other suitable substrate material that is insulating. For example, the substrate 16 might illustratively be made of glass, sapphire, quartz, plastic, polycrystalline silicon, amorphous silicon, silicon, silicon dioxide, silicon nitride, magnesium oxide, $Al_2O_3$ metal, gallium arsenide semiconductor substrates or any suitable material having acceptable properties. In an alternative embodiment, the substrate 16 may comprise a conductive material and an insulating layer disposed on top of the conductive material.

Formed on the substrate 16 are the component parts of the thermionic element with these parts being shown greatly enlarged and out of scale to better illustrate the structure. An electrically conductive material 18, such as gold, aluminum, copper, silicon, simple binary compounds, silicides, intermetallic, or the like, is formed in electrically isolated segments 18*a* and 18*b* on the substrate 16. The electrically conductive material 18 also forms and define a first void 20. As shown in FIG. 1A, one presently preferred embodiment has the first void 20 configured in a column shape. However, the first void 20 may alternatively be configured in a variety of shapes, such as trenches or troughs as discussed subsequently herein. The electrical isolation of the segments 18*a* and 18*b* is accomplished by creating a gap 22 between electrically isolated segments 18*a* and 18*b* of the electrically conductive material 18. The gap 22, as shown, is integrated with the first void 20. The cathode filament 12 is formed so that it traverses the first void 20 and partially rests on both isolated segments 18*a* and 18*b* of the electrically conductive material 18. The cathode filament 12 is in contact with the electrically conductive material 18 since it is via this layer that the cathode filament 12 will be stimulated to emit electrons. The electrically isolated segments 18*a* and 18*b* serve as conductors to deliver electrical energy to the cathode filament 12. The cathode filament 12 is thus heated by the electrical energy to cause it to thermionically emit electrons. The first void 20 serves to reduce the thermal load which might otherwise be imposed on the thermionic element during operation. In effect, the first void 20 serves to localize the cathode filament 12 to contain the heat therein and minimize heat dissipation to other components of the thermionic element.

The cathode filament 12 comprises a filament conductive layer made from a high temperature material such as molybdenum, platinum, tantalum, titanium, tungsten, nickel, intermetallics, semimetals, semiconductors, silicides, various compound materials, or the like. These materials may have a relatively low or matched coefficient of expansion which, because of the small distances which will be present between the component parts of the thermionic element, are desirable to minimize the possibility of the component parts thermally expanding or growing to ultimately touch one another. The latter event, of course, would disable the thermionic element. The filament conductive layer must also have a suitable electron emission. In thermionic emission, the electron emission from the cathode filament 12 is directly related to the operating temperature of the cathode filament 12 and inversely related to the work function of the cathode material. The work function is the work per unit charge required to free an electron from the metal. The filament conductive layer is in electrical communication with the isolated segments 18*a* and 18*b* of the electrically conductive material 18 in order to receive electrical energy.

In one presently preferred embodiment, the cathode filament 12 further comprises an filament insulating layer to support the filament conductive layer. The insulating layer comprises a material which is thermally and electrically insulating. Examples of such material include silicon dioxide and silicon nitride. The filament insulating layer provides sufficient support to allow for an extremely thin filament conductive layer. The filament insulating layer is disposed so as not to interrupt electrical communication between the filament conductive layer and the electrically conductive material 18.

Because of the support of the filament insulating layer, the filament conductive layer may range from less than 20 to approximately 1000 angstroms in thickness. Applications with a filament insulating layer of one monolayer and greater than one micron are also possible. The thin dimension of the filament conductive layer results in relatively little power consumption by the filament conductive layer.

Power dissipation also depends on material properties and geometry. Thus, electron emission is achieved more efficiently than previously experienced. The electrical pulse time is the time in which an energy source 30 is applied to the cathode filament 12 in order to generate an electron emission. The thin dimension of the filament conductive layer allows has electrical pulse times which are compatible with video rates needed for television and computer monitor applications. In theory, microsecond pulse times can be achieved such as less than 1 microsecond to 100 microseconds. Such electrical pulse times are more than suitable for applications with monitors and displays.

The electron pulse width is the duration of the electron emission from the cathode filament 12. The electron pulse width is a parameter determined by the design of the cathode filament 12. The electron pulse width may be determined by the materials used in the cathode filament 12. The electrical pulse time by itself is not determinative of the resulting electron pulse width.

The work function of the cathode filament 12 may be further lowered, thereby further improving electron efficiency, by disposing a thin low work function coating on the filament conductive layer. It is known in the art that applying the appropriate coating to a conductive layer will cause a substantial increase in current and electron efficiency. In particular, a tri-oxide coating, comprised of oxides of Barium, Strontium, and Calcium, is known to greatly improve the electron emission efficiency and thereby produce a cathode filament 12 which emits at lower temperatures and reduces the power consumption of the thermionic element. The low work function coating is formed and removed selectively using conventional semiconductor, micromachining, or microelectromechanical processing techniques including patterning and lift-off. In one presently preferred embodiment, the cathode coating is a mixture of barium carbonate, strontium carbonate, and calcium carbonate in 45:51:4 percent by weight ratio. Other cathode coatings with similar thermionic properties could also be used. It is known that when the cathode approaches a certain temperature (usually around 1000 degrees Celsius) the carbonates start to decompose to the respective oxides leaving a surface rich in barium. This surface will have a high electron emission efficiency and provides the basis for the active cathode. Because free barium is quite active chemically, process cleanliness and vacuum are important in achieving longevity.

In one presently preferred embodiment, the cathode filament 12 comprises a filament conductive layer disposed on a filament insulating layer and the filament conductive layer is coated with a low work function coating. In an alternative embodiment, the cathode filament 12 comprises a filament conductive layer disposed on a filament insulating layer without a low work function coating.

In yet another alternative embodiment, the cathode filament 12 comprises a filament conductive layer without a filament insulating layer. In such an embodiment the filament conductive layer must be sufficiently thick to bridge across the isolated segments 18*a* and 18*b*.

In another alternative embodiment, the low work function coating alone may be heated to produce electron emissions. Thus, in such an embodiment, the cathode filament 12 comprises a suitable low work function material disposed on the filament insulating layer. The low work function coating is in electrical communication with the conductive material 18 to thereby receive the electrical energy. The low work function coating has a thickness dimension which allows for relatively little power consumption and suitable electrical pulse times.

The thermionic element shown in FIGS. 1A and 1B also has an insulative layer 24 which is disposed on the electrically conductive material 18. The insulative layer 24 serves as an isolation layer to separate the cathode filament 12 and the anode 14. The insulative layer 24 may simply be a vacuum with some form of mechanical support to separate the cathode filament 12 and the anode 14. Alternatively, the insulative layer 24 may be a solid material such as ceramic, silicon dioxide, or the like which is formed on the electrically conductive material 18.

The insulative layer 24 surrounds a second chamber 26, such as a vacuum. The second void 26 surrounds the cathode filament 12. It is through the second void 26 that the electron emissions will pass. Disposed on the insulative layer 24 to bridge over the second void 26 is a screen 28. The screen 28 is preferably composed of translucent glass or other suitable material. The underside of the screen 28 is coated with a luminescent material which converts the received electron emissions into luminescent radiation which is referred to herein as an optical emission. In the preferred embodiment, the luminescent material is a phosphor coating. The phosphor coating acts as the anode 14 and receives and reacts to the electron emission by producing an optical emission which creates an image on the screen 28. These components together serve to create a vertically oriented, thermionic, diode or triode vacuum emitter device. Because of its utilization of vacuum properties, the thermionic element of this design is resistant to high and low temperatures and harsh environments such as high radiation.

The thermionic element is operated in essentially the same fashion as that of a conventional vacuum tube. This includes an energy source 30, such as electrical energy, which is coupled to otherwise electrically isolated segments 18*a* and 18*b* of the electrically conductive material 18. The segments 18*a* and 18*b* deliver the energy to heat the cathode filament 12 and cause it to emit electrons. Depending on the embodiment of the cathode filament 12, the thermal energy is delivered to the filament conductive layer or to the low work function coating. The thermal source of energy 30 might simply be a voltage source for supplying a current to the segment 18*b* to flow through the cathode filament 12 thereby causing it to heat and emit electrons. The circuit is completed by a return current path through segment 18*a*. An anode voltage 32 applies a voltage to the anode 14 thereby attracting the emitted electrons. The combination of the energy source 30 and the anode voltage 32 creates a voltage potential between the cathode filament 12 and the anode 14. Such operation of a diode is well-known in the art.

The thermionic elements may be fabricated using semiconductor fabrication, thin film, thick film, micromachining, and MEMS techniques. The cathode filament 12 and the conductive material 18 may also be created by fabrication at the molecular level. Footnote 1 lists various techniques and terms of art of molecular fabrication of semiconductors which is material formerly contained in the footnote:

Techniques in the art suitable for fabrication of the thermionic elements include: deposition, thin film deposition, monolithically form, surface reflow, micromachine, wet etch, dry etch, anneal, evaporate on, sputter on, plate, electroplate, diffuse on, anodize on, oxidize on, coat on, layer on, nucleate, spin on, screen print on, reaction form, absorb on, precipitate, photolithography, thermalithography, electophoresis, and thermophoresis. As defined herein, forming or formed encompasses all of these different methods and terms of art as they apply to semiconductor and thick film fabrication. Accordingly, each technique or term of art in footnote 1 could allow suitable fabrication of the thermionic element.

The preferred embodiment uses a fabrication process involving a photolithographic technique with several photomasking steps. The following fabrication technique is illustrative of one method for forming the thermionic device of the present invention. However, those skilled in the art will appreciate that many variations in fabrication are possible as illustrated by the techniques represented in Table 1.

Fabrication of the thermionic element commences by selecting a substrate 16 of any suitable material such as those previously disclosed above. The substrate 16 is cleaned to remove contaminants such as residual organic contaminants, certain metals, and atomic and ionic contaminants. The first step of the photolithography process is to create a first mask to define a layer for the electrically conductive material 18. A second mask defines the layer for the cathode filament 12. A third mask is used if the desired insulative layer 24 is a solid material. The third layer defines the insulative layer 24 which is used to separate the cathode and anode layers from one another. The third layer insulative layer 24 may be formed using a Pyrox reactor, plasma enhanced chemical vapor deposition (PECVD), low pressure chemical vapor deposition (LPCVD), sputtering, or other similar techniques. The third insulative layer 24 may be wet (chemical) etched or dry (plasma) etched. A fourth mask defines bonding pads for the cathode filament 12. Finally, a screen 28 with one side coated with phosphors serving as the anode 14 are disposed on the insulative layer 24. The spacing between the cathode filament 12 and anode 14 may be fabricated to be less than one micron to considerably over one centimeter. In one presently preferred embodiment the spacing would be about two to five microns to one millimeter. In one presently preferred embodiment a single thermionic element would have a horizontal planar dimension ranging from less than one micron to 1000 microns.

Although a single thermionic element is shown in FIGS. 1A and 1B, it is apparent that a plurality of such devices could be formed on the substrate 16. Each individual device on the substrate 16 could be insulated and separated from one another by gaps, voids, or high temperature insulator material such as ceramic, silicon dioxide, sapphire, or the like. The gaps, voids, or high temperature insulators would be deposited on the substrate such that they surrounded each device.

FIG. 1B provides a perspective view of the device of FIG. 1A, which more clearly illustrates the column void 20 over which the cathode filament 12 is formed, being defined by the segments 18*a* and 18*b* which are not in physical contact because of the gap 22, but are electrically coupled by the cathode filament 12.

Figure 2:
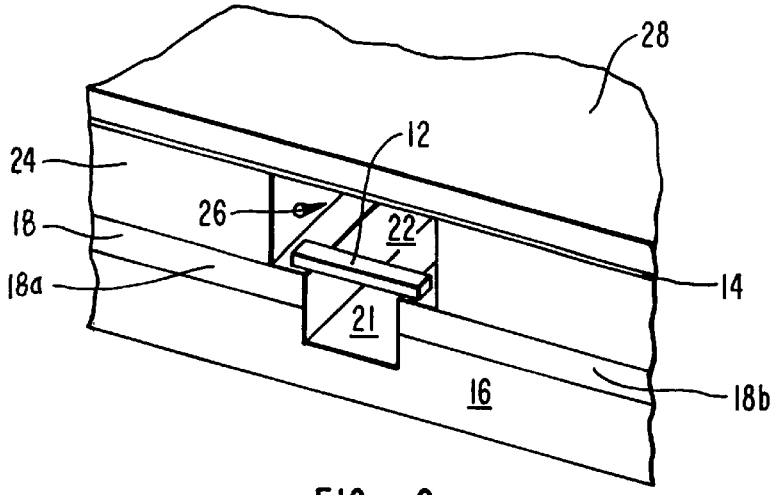
FIG. 2 is a perspective view of an alternative embodiment of the thermionic element.

FIG. 2 is a perspective view of an alternative embodiment of a thermionic element wherein it has a first void 21 embodied as a trench or trough. As with a column void, the trench void 21 serves to localize and isolate the cathode filament 12 to reduce the thermal load which might otherwise occur on the other components of the thermionic element. It should be noted that the electrically conductive material 18 is still separated into electrically isolated segments 18*a* and 18*b* to provide a series path for heat to travel through the cathode filament 12. In such an embodiment, the first void 21 would also comprise the gap which is used to isolate the segments 18*a* and 18*b* of the low resistance material 18. The alternative embodiment of FIG. 2 also has the first void 21 extending into the substrate 16 directly below the cathode filament 12. The first void 21 is expanded into the substrate 16 by etching out a portion of the substrate 16.

Figure 3A:
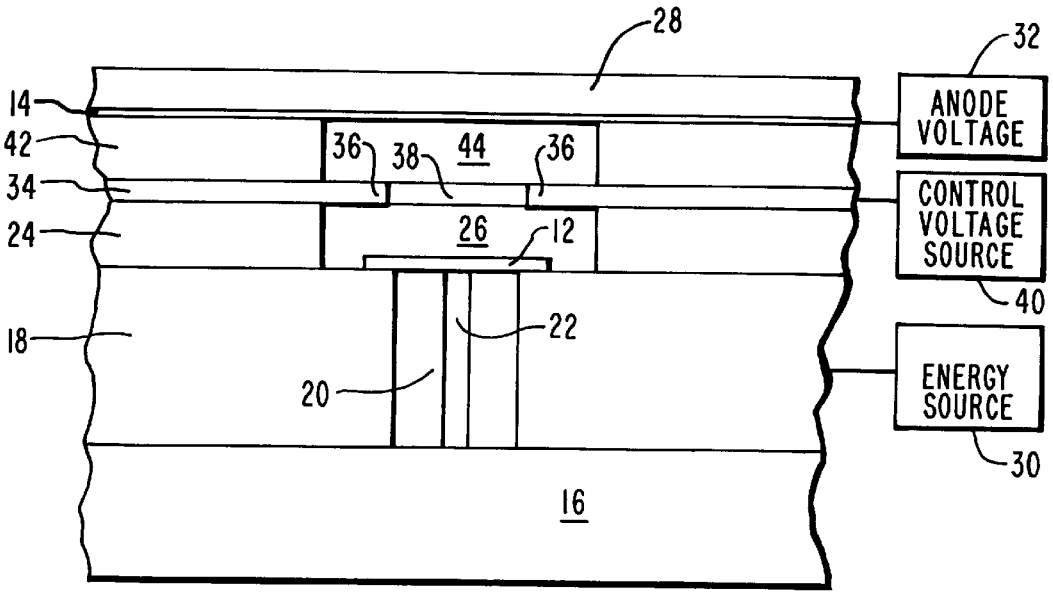
FIG. 3A is a side, cross-sectional view of an alternative embodiment of the thermionic element.
Figure 3B:
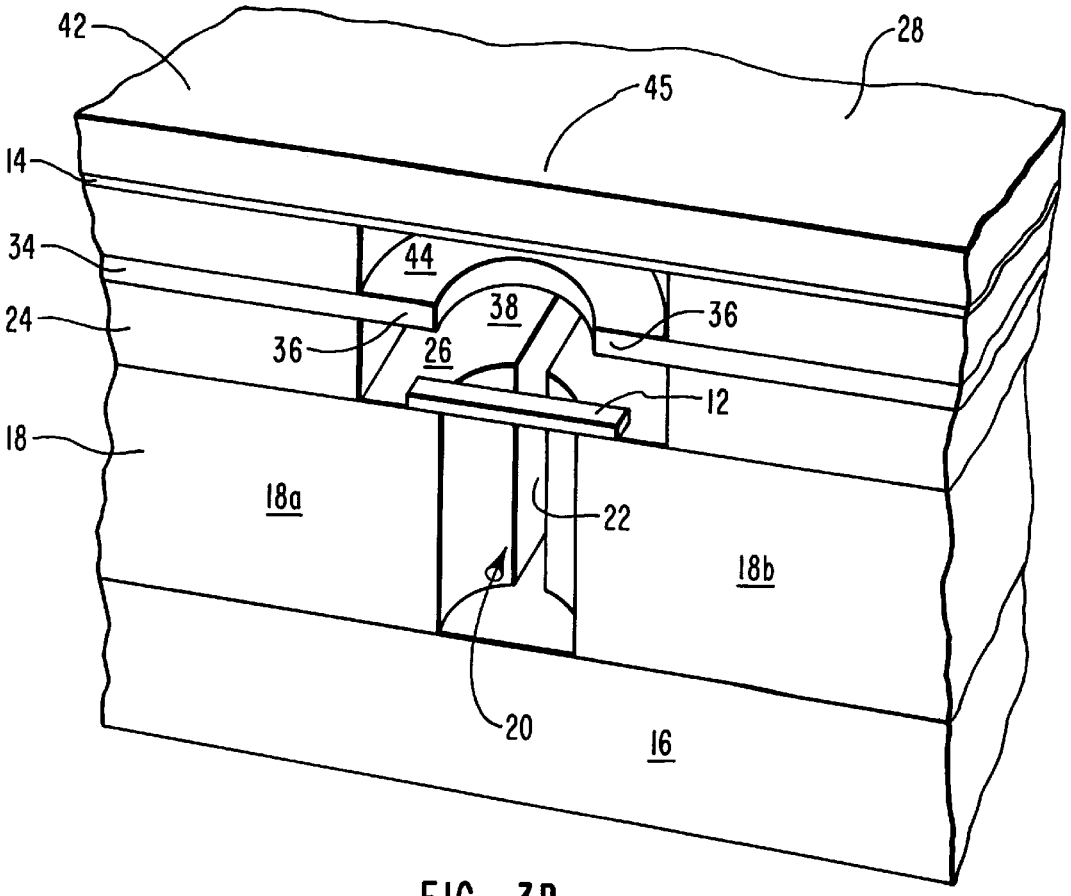
FIG. 3B is a perspective view of the thermionic element shown in FIG. 3A.

In FIGS. 3A and 3B an alternative embodiment is shown wherein the thermionic element further comprises an electrically conductive grid layer 34. The electrically conductive grid layer 34 is preferably formed using solid-state semiconductor, thin film, thick film, MEMS, micromachining, and sputtering techniques and is adjacent to the insulative layer 24. As shown, a portion 36 of the electrically conductive grid layer 34 projects into the second void 26. Alternatively, the grid layer 34 could remain flush with the insulative layer 24. In either embodiment, the grid layer 34 defines an opening 38 positioned in vertical alignment directly above the cathode filament 12. The grid layer 34 serves as a conventional grid in a triode vacuum tube structure.

Electrically coupled to the grid layer 34 is a control voltage source 40 for selectively applying a voltage to the grid layer 34 to control the flow of electrons through the opening 38 of the grid layer 34 from the cathode filament 12. The grid layer 34 controls the flow of electrons through the opening 38 which effectively controls the electrons reaching the anode 14 to develop a desired electrical current. Hence, the presence of the grid layer 34 serves to amplify the current from the cathode filament 12. The grid layer 34 typically operates such that the more positive the voltage source which is applied to the control grid, the brighter the pixel in a monochrome display or the brighter the color component in a color display. By varying the voltage applied to the control grids of each thermionic element for each pixel or color component, the desired image can be produced.

As also shown in FIGS. 3A and 3B, disposed on the grid layer 34 is a second insulative layer 42. The second insulative layer 42 defines a third void 44 which is above the opening 38 in the grid layer 34. The second insulative layer 42 may be comprised of the same material as the insulating layer 24, including a vacuum with some form of mechanical support. As with the previous embodiment, a phosphor coating on the screen 28 serves as the anode 14 to receive electron emissions. This provides a vertically oriented triode thermionic emission device. One of skill in the art will appreciate that thermionic emission devices of higher electrode count may be constructed and are included within the scope of the invention.

Figure 4:
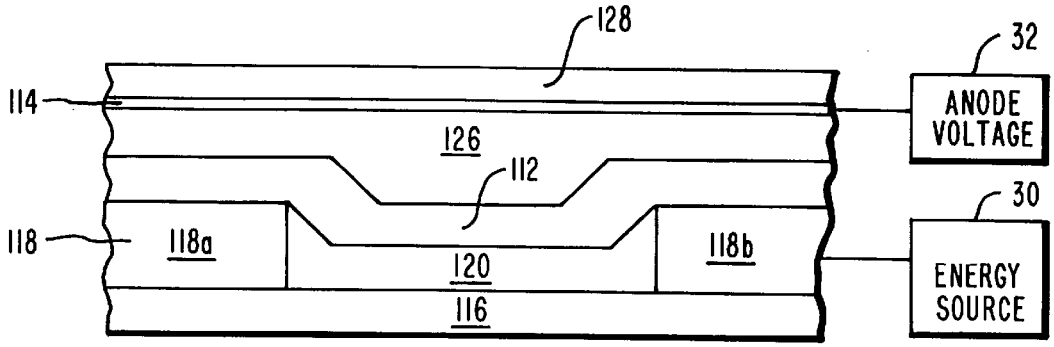
FIG. 4 is a side, cross-sectional view of an alternative embodiment of the thermionic element.

In FIG. 4 an embodiment of the thermionic element is shown wherein the cathode filament 112 is formed in an alternative manner. The cathode filament 112 is heated when formed to the point of being deformable. When formed on the electrically conductive material 118, the cathode filament 112 will also substantially contact the substrate 116 thereby filling the first void 120. The cathode filament 112 is then cooled which causes the cathode filament to rise above the substrate 116 and define the first void 120. This embodiment facilitates manufacture because the cathode filament 112 may be more easily guided and formed when deformable. Furthermore, when cooled, the rising cathode filament 112 will naturally create a vacuum in the first void 120.

Figure 5:
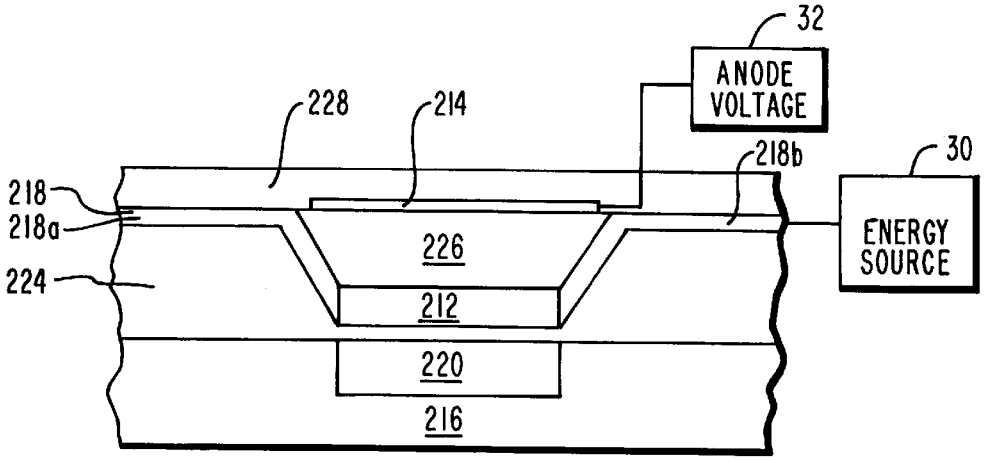
FIG. 5 is a side, cross-sectional view of an alternative embodiment of the thermionic element.

In FIG. 5 an alternative embodiment of the thermionic element is shown wherein the first void 220 is completely defined by etching out a portion of the substrate 216. The insulative layer 224 is preferably of a solid material and is formed on the substrate 216. A portion of the insulative layer 224 is etched out to define the second void 226. The electrically conductive material 218 is formed on the insulative layer 224 into electrically isolated segments 218*a* and 218*b*. The cathode filament 212 is formed on the insulative layer 224 at the bottom of the second void 226 and couples the segments 218*a* and 218*b* thereby creating a series path. A screen 228 is then disposed directly on the conductive material 218. The screen 228 has its underside partially coated with a phosphor coating which serves as the anode 214. Attention is made to coat the screen 228 with the phosphor coating 214 so that the conductive material 218 does not contact the phosphor coating 214.

Figure 6:
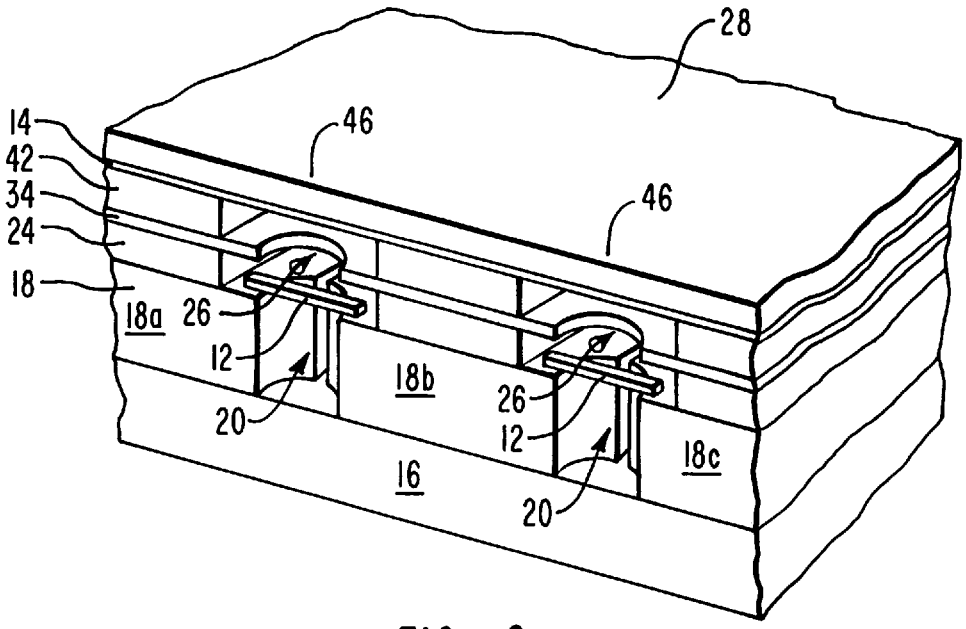
FIG. 6 is a perspective view of an array of thermionic elements as embodied in FIGS. 3A and 3B.

Turning to FIG. 6, a two dimensional array of thermionic elements as embodied in FIGS. 3A and 3B is shown. Each thermionic element is generally designated 46. Such an array may form a portion of a pixel in the emission device of the present invention. An array containing less than 1 to 1000 thermionic element devices may define one color of pixel in the emission device of the present invention. Accordingly, the pixel size is scalable by varying the number of thermionic elements per pixel. This redundancy allows for a highly reliable display. In monochrome applications, a pixel consists of one color, while in color applications, three colors are typically required. A number of such pixels in the horizontal and vertical quantities desired in a specific display application, such as 1024×1024, would define an emission device of the present invention when used in conjunction with the phosphor coating 14 of a screen 28.

As shown in FIG. 6, the component parts of the thermionic elements utilized to excite the phosphor coating 14 and create the image seen by an observer are formed on substrate 16. As discussed above, the component parts of the thermionic elements include a conductive material 18 formed around a first void 20 and a cathode filament 12 formed over the first void 20 and partially over the conductive material 18. The cathode filament 12 is formed in contact with the segments 18*a*, 18*b*, or 18*c* in order to receive the energy to produce electron emission. It should be remembered that electrically conductive substrate 18 is divided into electrically isolated segments 18*a*, 18*b*, and 18*c* such that a source of energy applied to one segment will cause the cathode filaments 12 which bridge the gap between the otherwise electrically isolated segments 18*a*, 18*b*, and 18*c* to become hot and emit electrons. An insulative layer 24 is disposed adjacent to the low resistance inter-connect metal 18 and around a second void 26 which surrounds the cathode filament 12. Grid layer 34 is formed adjacent to the insulative layer 24. The second insulative layer 42 is disposed adjacent to the grid layer 34. Finally, a screen 28 with a phosphor coating 14 is disposed on the insulative layer 24.

A group of thermionic elements 46 on the substrate 16 which represent a color for one pixel would be insulated and separated from a group of thermionic elements 46 which represent another color of the pixel. This would allow manipulative control of the resulting color of the pixel by adjusting the energy, anode voltage, and control voltage for each color group. Similarly, thermionic elements corresponding to different pixels would be insulated and separated from one another. Such insulation would be accomplished by inserting insulative layers such as ceramic, silicon dioxide, sapphire, or voids around the different groups of thermionic elements.

Figure 7:
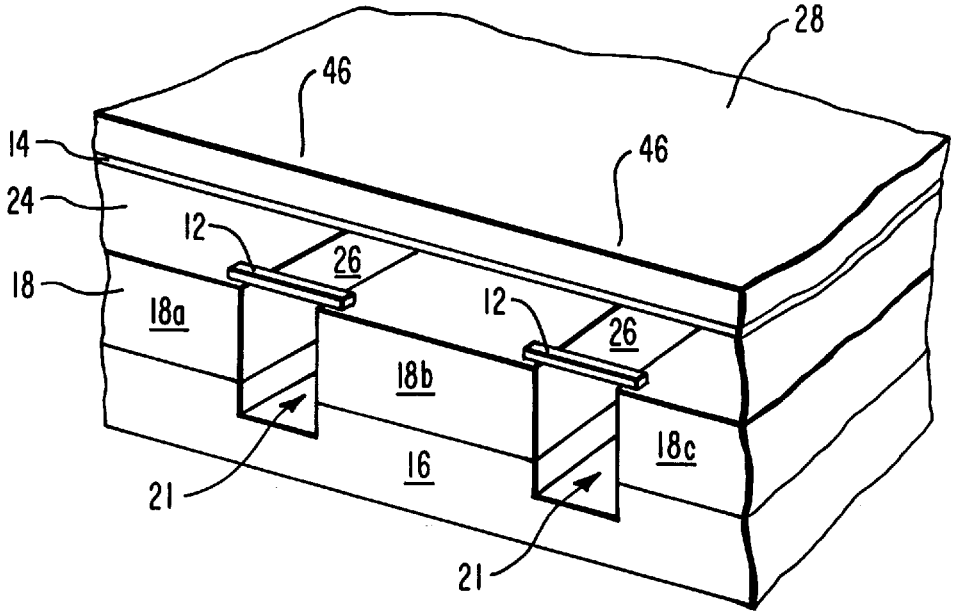
FIG. 7 is a perspective view of an array of thermionic elements as embodied in FIG. 2.

Turning to FIG. 7, a two dimensional array of thermionic elements as embodied in FIG. 2 is shown. In this embodiment the insulative layer 24 comprises a vacuum which is integrated with the second void 26. The insulative layer 24 is also common to all the thermionic elements 46. As with the embodiment of FIG. 6, the thermionic elements are grouped to define one color of a pixel and would be insulated from one another. Likewise, the thermionic elements are controlled by adjusting the amount of energy and anode voltage to a particular group of thermionic elements representing a color.

Figure 8:
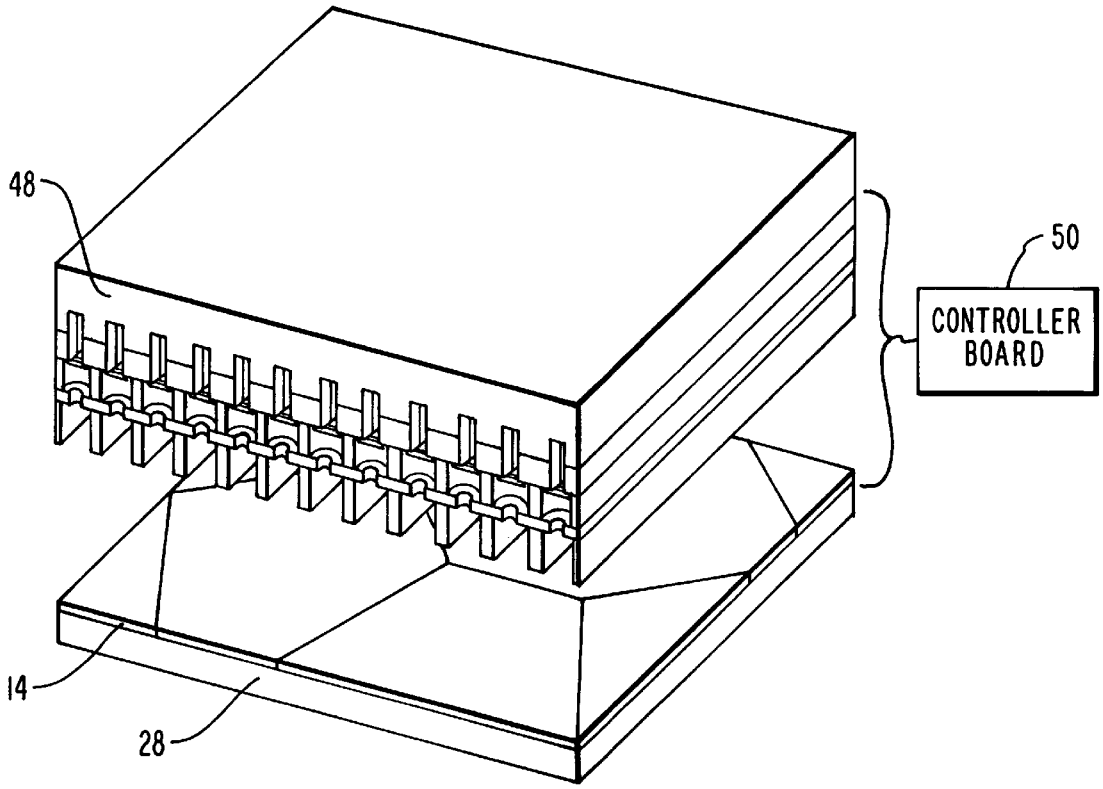
FIG. 8 is a partially exploded perspective view of one embodiment of the phosphor coated emission device of the present invention.

Turning to FIG. 8 a perspective view of a portion of the thermionic optical emission device is shown with a display means comprising the screen 28 and the phosphor coating 14. A portion of the two dimensional thermionic element array is also shown and is generally designated 48. The array 48 of FIG. 8 is similar to that shown in FIG. 6 but is shown in reverse so that the relation to the screen 28 can be better illustrated. However, the nature of the illustration precludes showing all the details shown in FIG. 6, such as the electrical isolation of segments of the conductive material 18.

The phosphor coating 14 comprises blue, red, and green phosphors which are allocated to specific, individual areas on the screen 28. Thus, in color display applications, a number of thermionic elements are associated with a red area of phosphors, a blue area of phosphors, and a green area of phosphors for each pixel. As discussed previously, each group of thermionic elements corresponding to a color of phosphors for each pixel is separately controlled. Each group of thermionic elements is selectively controlled to excite a corresponding color of phosphors to a particular intensity. The combination of excited colored phosphors creates the desired pixel color. A combination of pixels creates the desired image.

Utilization of high numbers of thermionic elements for each pixel yields a highly reliable display system which produces sharp images. The pixel size is also scalable by configuring the array to provide a different number of thermionic elements for each pixel. Accordingly, the complete image portrayed on the screen 28 is scalable.

Control of the electron emission of an individual thermionic element is dictated by a control signal sent to the thermionic element. The control signal determines the application of the energy source 30 to the cathode filament, the anode voltage 32 to the anode, and, if an applicable embodiment, the voltage source 40 to the control grid 34. The intensity of the optical emission and the resulting image directly corresponds with the strength of the received electron emission. Accordingly, increasing the applied energy source 30, anode voltage 32, and voltage source 40 will increase the electron emission and the intensity of the image.

A controller board 50 is electrically coupled to the array 48 and controls the thermionic elements by generating and sending appropriate control signals to them. The control signal will dictate the amount energy source 30, voltage 32, and, if applicable, voltage source 40 applied to an individual or group of thermionic elements. In this manner, the intensity of the electron emissions of an individual or group of thermionic elements can be turned on or off or even varied in intensity as desired. In the preferred mode of operation the electron emissions are pulsed as needed by selectively turning the thermionic element on and off. The controller board allows minimalization of power consumption by reducing the energy source 30 and voltage 32 to the thermionic elements. Alternatively, the energy source 30 and/or the voltage 32 may be increased and/or nonpulsed to provide optimal performance of the emission device. Furthermore, the controller board may selectively increase or decrease the intensity of certain pixels on the emission device if desired.

Figure 9:
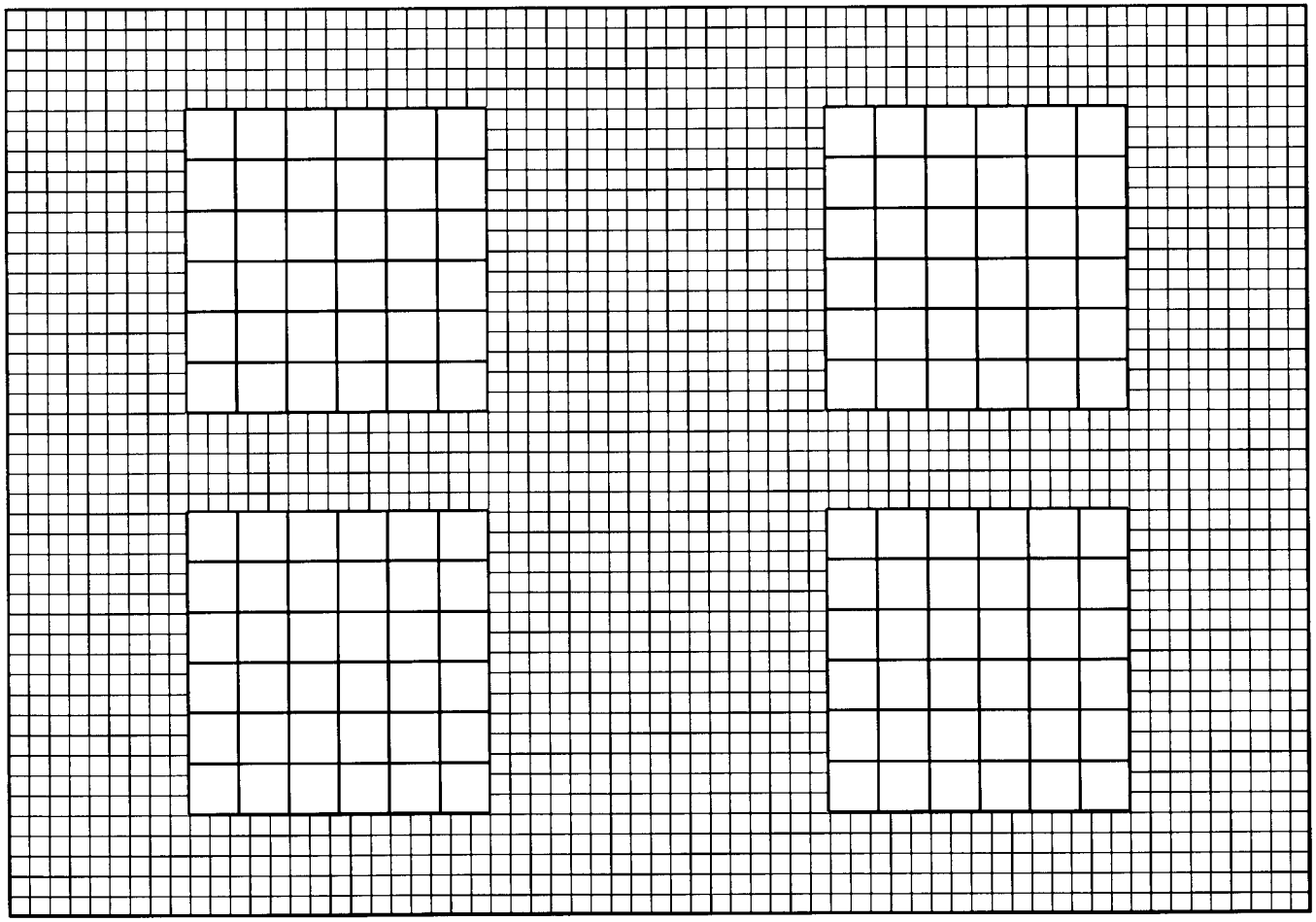
FIG. 9 is a plan view of one possible image displayed on the screen illustrating variable pixel size.

The display system may be entirely composed of thermionic elements of approximately equal size which are uniformly distributed across the screen 28. This can produce pixels of uniform size throughout the screen 28. Alternatively, the size of the pixels may be varied to produce a screen 28 with different pixel sizes. This may be desired in a variety of situations given the numerous applications of displays. With reference to FIG. 9, an illustrative example of a screen 28 with different pixel sizes is shown. For illustrative purposes, each square is representative of a pixel size.

Different pixel sizes on a screen may be accomplished by placing a greater concentration of thermionic elements for each pixel at certain locations corresponding to the screen 28. Different pixel sizes may also be accomplished by placing thermionic elements of a different size at certain locations corresponding to the screen 28. The same number of different sized thermionic elements will result in a correspondingly different sized pixel. Finally, as mentioned previously, pixel sizes may also be scalable by configuring the array to provide a different number of thermionic elements for each pixel. Thus, the display system of the present invention allows for uniform pixels and for multiple pixel sizes.

The display system of the present invention provides a relatively thin paneled display capable of use in numerous display applications. For example, the present invention may be used to replace CRT and FED monitors or displays for computers and television. The display system may be used for dashboard displays on automobiles, microwave ovens, or wherever LED displays are currently used.

Furthermore, the display system can be used for lighting applications. For example, the display system can be used for taillights, headlights, and floodlights of automobiles. The display system can also be used for the interior lighting of an automobile. The display system has the advantage of a relatively thin dimension and light weight to provide unobtrusive lighting which may be readily located where desired.

The display system of the invention may be embodied as a substantially planar "flat panel" display device. Such an embodiment makes the display system ideally suited for mounting to a wall surface or other flat panels. Alternatively the display system can be nonplanar with a curvature. Such an embodiment would allow the display system to conform to the contour of a surrounding environment such as an automobile dashboard. In either embodiment, the display system retains its relatively thin dimension.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A thermionic optical emission device, comprising:

a plurality of thermionic elements arranged in a two dimensional array capable of producing electron emissions, wherein each thermionic element includes a substrate, an electrically conductive material formed on said substrate to form at least two electrically isolated segments, cathode means formed adjacent to said electrically conductive material, said cathode means electrically coupling said electrically isolated segments to form a series path between said segments, said cathode means emitting electrons when heated, a void adjacent at least a portion of said cathode means, and means for delivering electrical energy to said electrically conductive material to thereby heat said cathode means; and a display means disposed on the two dimensional array for receiving and reacting to the electron emissions of said thermionic elements to thereby produce an image.

2. A thermionic optical emission device as defined in claim 1 wherein said substrate surrounds and defines at least a portion of said void.

3. A thermionic optical emission device as defined in claim 1 wherein said electrically conductive material surrounds and defines at least a portion of said void.

4. A thermionic optical emission device as defined in claim 1 wherein said electrically conductive material is selected from the group consisting of gold, aluminum, copper, silicon, suicides, simple binary compounds, and intermetallic.

5. A thermionic optical emission device as defined in claim 1 wherein said cathode means comprises a filament conductive layer made of material selected from the group consisting of molybdenum, platinum, titanium, tantalum, tungsten, nickel, and intermetallic.

6. A thermionic optical emission device as defined in claim 1 wherein said cathode means comprises a filament conductive layer disposed on a filament insulating layer.

7. A thermionic optical emission device as defined in claim 6 wherein said cathode means further comprises a low work function material disposed on said filament conductive layer.

8. A thermionic optical emission device as defined in claim 1 wherein said cathode means comprises a low work function material disposed on a filament insulating layer.

9. A thermionic optical emission device as defined in claim 1 wherein said cathode means has an electrical pulse time less than 1 to 100 microseconds.

10. A thermionic optical emission device as defined in claim 1 further comprising means for controlling the electron pulse width of the electron emissions.

11. A thermionic optical emission device; comprising:

a plurality of thermionic elements arranged in a two dimensional array capable of producing electron emissions, wherein each thermionic element includes a substrate, an electrically conductive material formed on said substrate to form at least two electrically isolated segments, cathode means formed adjacent to said electrically conductive material to couple said electrically isolated segments to form a series path between said segments, said cathode means emitting electrons when heated, a void adjacent at least a portion of said cathode means for reducing thermal conductivity between said cathode means and said substrate, an electrically insulative layer disposed on said electrically conductive material, an electrically conductive grid means formed adjacent to said electrically insulative layer and defining an opening therein above said cathode means for allowing the passage of electrons therethrough, means for delivering electrical energy to said electrically conductive material to thereby heat said cathode means, and means for selectively supplying a voltage to said electrically conductive grid means to control the magnitude of the flow of electrons through the opening therein; and a display means disposed on the two dimensional array for receiving and reacting to the electron emissions of said thermionic elements to thereby produce an image.

12. A thermionic optical emission device as defined in claim 11 wherein said substrate surrounds and defines at least a portion of said void.

13. A thermionic optical emission device as defined in claim 11 wherein said electrically conductive material surrounds and defines at least a portion of said void.

14. A thermionic optical emission device as defined in claim 11 wherein said electrically conductive material is selected from the group consisting of gold, aluminum, copper, silicon, silicides, simple binary compounds, and intermetallic.

15. A thermionic optical emission device as defined in claim 11 wherein said cathode means comprises a filament conductive layer made of material selected from the group consisting of molybdenum, platinum, titanium, tantalum, tungsten, nickel, and intermetallic.

16. A thermionic optical emission device as defined in claim 11 wherein said cathode means comprises a filament conductive layer disposed on a filament insulating layer.

17. A thermionic optical emission device as defined in claim 16 wherein said cathode means further comprises a low work function material disposed on said filament conductive layer.

18. A thermionic optical emission device as defined in claim 11 wherein said cathode means comprises a low work function material disposed on a filament insulating layer.

19. A thermionic optical emission device as defined in claim 11 wherein said electrically conductive grid means is made of material selected form the group consisting of tungsten, gold, and tantalum.

20. A thermionic optical emission device as defined in claim 11 wherein said cathode means has an electrical pulse time less than 1 to 100 microseconds.

21. A thermionic optical emission device as defined in claim 11 further comprising means for controlling the electron pulse width of the electron emissions.

22. A thermionic optical emission device, comprising:

a plurality of thermionic elements arranged in a two dimensional array capable of producing electron emissions, wherein each thermionic element includes a substrate which surrounds and defines a first void, an electrically insulative layer disposed on said substrate to bridge over said first void to surround and define a second void, an electrically conductive material formed adjacent to said electrically insulative layer to form at least two electrically isolated segments, cathode means formed adjacent to said electrically insulative layer and within said second void, said cathode means electrically coupling said electrically isolated segments to thereby form a series path between said segments, and means for delivering electrical energy to said electrically conductive material to thereby heat said cathode means; and a display means disposed on the two dimensional array for receiving and reacting to the electron emissions of said thermionic elements to thereby produce an image.

* * * * *

UNITED STATES PATENT AND TRADEMARK OFFICE

CERTIFICATE OF CORRECTION

PATENT NO : 5,955,828
DATED : September 21, 1999
INVENTOR(S) : Laurence P. Sadwick and R. Jennifer Hwu It is certified that error appears in the above-identified patent and that said Letters Patent are hereby corrected as shown below:

In column 14, line 13 after the word silicon, please delete "suicides" and insert therefor --silicides--.

Signed and Sealed this

Third Day of April, 2001

*Attest:*

Nicholas P. Godici

NICHOLAS P. GODICI

*Attesting Officer*

*Acting Director of the United States Patent and Trademark Office*